US005832798A

United States Patent [19]

Schneider et al.

[11] Patent Number: 5,832,798

[45] Date of Patent: Nov. 10, 1998

[54] PUNCH UNIT

[75] Inventors: Albrecht Schneider, Oberursel, Germany; Gary E. Johnson, Ramsey, Minn.; Gerd Simon, Chemnitz, Germany

[73] Assignee: Mate Precision Tooling Inc., Ramsey, Minn.

[21] Appl. No.: 469,905

[22] Filed: Jun. 6, 1995

[30] Foreign Application Priority Data

| | | | |
|---|---|---|---|
| Aug. 10, 1994 | [DE] | Germany | 44 28 286.9 |
| Mar. 8, 1995 | [DE] | Germany | 195 08 091.2 |

[51] Int. Cl.[6] ..... B26D 7/06

[52] U.S. Cl. ..... 83/140; 83/698.11; 83/698.91

[58] Field of Search ..... 83/140, 698.91, 83/698.11, 588, 698.31; 403/330, 327, 326

[56] References Cited

U.S. PATENT DOCUMENTS

| | | | |
|---|---|---|---|
| 2,172,272 | 9/1939 | Booth . | |
| 3,079,824 | 3/1963 | Schott . | |
| 3,296,905 | 1/1967 | Killaly | 83/698.91 X |
| 3,335,627 | 8/1967 | Smelts . | |
| 3,772,954 | 11/1973 | De Ruwe et al. | 83/698.91 X |
| 3,779,113 | 12/1973 | Jestin | 83/140 |
| 3,871,254 | 3/1975 | Whistler, Jr. et al. | 83/140 X |
| 3,935,771 | 2/1976 | Cady, Jr. | 83/140 |
| 3,935,772 | 2/1976 | Demus et al. | 83/140 |
| 3,958,476 | 5/1976 | Bartha | 83/143 X |
| 4,092,888 | 6/1978 | Wilson | 83/140 |
| 4,166,403 | 9/1979 | DiDonato, Jr. et al. | 83/139 X |
| 4,367,971 | 1/1983 | Coren | 403/330 |
| 4,375,774 | 3/1983 | Wilson et al. | 83/140 |
| 4,440,052 | 4/1984 | Weisbeck | 83/140 |
| 4,457,196 | 7/1984 | Cady | 83/140 |
| 4,691,602 | 9/1987 | Schlueter | 83/140 X |
| 4,989,484 | 2/1991 | Johnson et al. | 83/140 |
| 5,054,347 | 10/1991 | Johnson et al. | 83/140 |
| 5,056,392 | 10/1991 | Johnson et al. | 83/140 |
| 5,081,891 | 1/1992 | Johnson et al. | 83/140 |
| 5,131,303 | 7/1992 | Wilson et al. | 83/140 |
| 5,176,057 | 1/1993 | Chun et al. | 83/140 X |
| 5,301,580 | 4/1994 | Rosene et al. | 83/140 X |
| 5,329,835 | 7/1994 | Timp et al. | 83/698.71 X |
| 5,419,225 | 5/1995 | Fujita | 83/140 |

FOREIGN PATENT DOCUMENTS

| | | | |
|---|---|---|---|
| 0 000 762 | 2/1979 | European Pat. Off. . | |
| 1414343 | 9/1965 | France . | |
| 40-6551 | 1/1994 | Japan . | |
| 406015382 | 1/1994 | Japan | 83/664 |
| 2 050 910 | 1/1981 | United Kingdom . | |
| 94/07663 | 4/1994 | WIPO . | |

*Primary Examiner*—Maurina T. Rachuba
*Attorney, Agent, or Firm*—Larson & Taylor

[57] ABSTRACT

The punch unit comprises a punch driver connected with a punch which on its back end has a base. Furthermore, safeguarding members which keep the punch and the punch driver free of relative rotation during the stroke of the punch, and a pre-loaded compression spring which during the stroke of the punch can be compressed between the base and a guide bushing receiving the punch so that it cannot be rotated, but is axially displaceable, are part of it. To obtain a simpler and quicker assembly and disassembly of the punch it is provided that the pressure spring is maintained under pre-load in the guide bushing which is embodied as one or several pieces. A catch releasably supported on the rear end of the guide bushing and releasably engaging a recess, open toward the back, in the circumferential surface of the punch driver head prevents the punch driver head from jumping toward the back out of the guide bushing.

31 Claims, 2 Drawing Sheets

PUNCH UNIT

FIELD OF THE INVENTION

The invention relates to a punch unit, comprising a punch driver connected with a punch which punch driver has a base at its back end, safeguarding members, which keep the punch and the punch driver free of relative rotation during the stroke of the punch, and a pre-loaded compression spring which, during the stroke of the punch, can be compressed between the base and a guide bushing receiving the punch so that it cannot be rotated, but is axially displaceable.

BACKGROUND OF THE INVENTION

A punch unit of this type is known from U.S. Pat. No. 5,131,303. In this structure the back end of the punch, which is provided with an exterior thread, is screwed into a threaded bore at the front end of the punch driver. The threaded section at the back end of the punch is provided with four axial, longitudinal grooves, and an open spring washer, whose one end is radially bent inward and projects through a radial hole into one of the axial grooves of the punch. The spring washer is seated on the exterior circumference of the front end of the punch driver. In the assembled state a guide bushing is frictionally connected via an O-ring with a washer seated on the punch driver underneath the compression spring and prevents the spring washer from being able to yield radially outward. In this way the punch and the punch driver are directly connected with each other by the spring washer without being able to rotate.

When the punch is to be reground, the punch driver can be pulled away from the guide bushing toward the rear, in the course of which the frictional connection at the O-ring is released. After the spring washer has left the guide bushing, the threaded connection between the punch and the punch driver can be released by relative rotation. Because the radially inward bent end of the open spring washer has a point and the lateral walls of the grooves are inclined, the free end of the spring washer is pushed out of the groove in which it had been engaged when the punch is rotated in relation to the punch driver and, with continued relative rotation, then engages the next groove. Knowing the thread pitch, it is also known which change in the total length of the punch and punch driver corresponds to the rotational angle between two grooves. Because of this it is possible in a very simple way to reset the total length of the punch and punch driver following the regrinding of the punch. As soon as the guide bushing has subsequently again been pushed over the open spring washer and has been frictionally connected with the punch driver via the O-ring, the screw connection between the punch and the punch driver is again dependably blocked against relative rotation because the guide bushing does not permit the open spring washer to widen radially, so that therefore its radially inwardly bent end no longer can leave the radial groove with which it is in engagement at that time.

Although the known punch unit assures a simple setting of the total length of the punch and punch driver, it suffers from the essential disadvantage that the grooves intended for safeguarding against relative rotation weaken the thread through which the large punching forces are transmitted to the punch. This is of particular disadvantage in connection with punches having a relatively small cross section, as finer adjustment is required with decreasing cross section, because it is then necessary to have correspondingly more grooves at the circumference. Furthermore, the assembly and the installation or removal of the punch, for example for regrinding, are comparatively difficult and involved because the compression spring is seated under pre-load on the punch driver, which makes itself felt in a disruptive way during every manipulation.

SUMMARY OF THE INVENTION

It is therefore the primary object of the invention to provide a punch unit of the initially mentioned type with a limited return stroke of the punch, which permits a simpler and more rapid installation and removal of the punch.

The above object is attained in accordance with the invention in that the compression spring is held in a pre-loaded manner in a bushing, which is embodied in one or several pieces, and the punch driver in the position where it is inserted into the bushing is kept by a releasable catch supported on the bushing from a movement toward the back.

The proposed punch unit has the advantage that even in the completely assembled state there is only one unit comprised of the punch and the punch driver which, after releasing the catch, can be easily pushed out of the bushing toward the back or upward and pulled out without a need for a tool. In a corresponding manner it is sufficient at the end of the assembly operation and following regrinding, as well as during a replacement of the punch, to let the punch together with the punch driver slide into the bushing from behind or above.

To be able to compensate for the loss of length because of the regrinding of the punch, there is customarily a threaded connection between the punch and the punch driver which permits the adjustment of the length. In this case it is also necessary to see to it that the punch and the punch driver are connected with each other during operation in such a way that they cannot rotate in relation to each other. The punch unit in accordance with the invention permits the embodiment of the safeguard elements in the way described in U.S. Pat. No. 5,131,303. However, a simpler design is preferred, wherein the safeguard elements are constituted by a connection between the punch driver and the bushing which is interlocking in the circumferential direction. Since in the process the punch, on the one hand, and the punch driver, on the other, are guided in the bushing so they cannot rotate, they are also maintained secure against relative rotation in respect to each other.

The interlocking connection between the punch driver and the bushing is preferably provided on the back end of the latter, i.e. back of the back spring bearing. In a particularly simple embodiment, the base of the punch driver is embodied with a plurality of axial grooves distributed over the circumference, which are engaged by at least one radially inward pointing protrusion of the bushing.

The novel punch unit can be realized in the form that the threaded connection, by means of which the length compensation is performed following grinding, is located at the back end of the punch and the front end of the punch driver. However, alternatively the shaft of the punch driver can also be embodied as one piece with the punch. In this case a threaded connection between the back end of the shaft and the base of the punch driver is provided.

With the novel punch unit, the front part of the bushing performs the function of guiding the punch, while the back part receives the pre-loaded spring and maintains the punch driver secure against relative rotation. Because of the different functions, it is recommended to manufacture the front and back parts of the bushing in the form of two separate parts, a guide bushing and a sliding bushing, respectively, and to connect them, secure against relative rotation, preferably by means of an axial plug connection. In the process the front spring bearing is suitably formed by a shoulder at the connection of the guide and sliding bushings and the back spring bearing by a ring insert, which can be screwed into the back end of the sliding bushing or can be fastened in another way, by means of which the pre-load of the compression spring can be set. Simultaneously the ring insert, which can be fixed in place in the desired rotational angle position in the bushing, can have the mentioned radial protrusion, which engages an axial groove in the base of the punch driver and in this way prevents its rotation. To change the length of the unit comprised of the punch and the punch driver, it is sufficient to release the catch and to push the base of the punch driver out of the ring insert or the bushing toward the back and to turn it by one or several groove pitches. The selected length setting is preserved after the punch driver base has again been inserted into the back end of the bushing.

The invention will be explained in detail below by means of an exemplary embodiment illustrated in the drawings.

BRIEF DESCRIPTION OF THE DRAWINGS

There follows a detailed description of the preferred embodiments of the present invention which are to be taken together with the accompanying drawings, wherein.

DETAILED DESCRIPTION OF THE PREFERRED EMBODIMENTS

Referring now to the figures, like elements are represented by like numerals throughout the several views.

Figure 1:
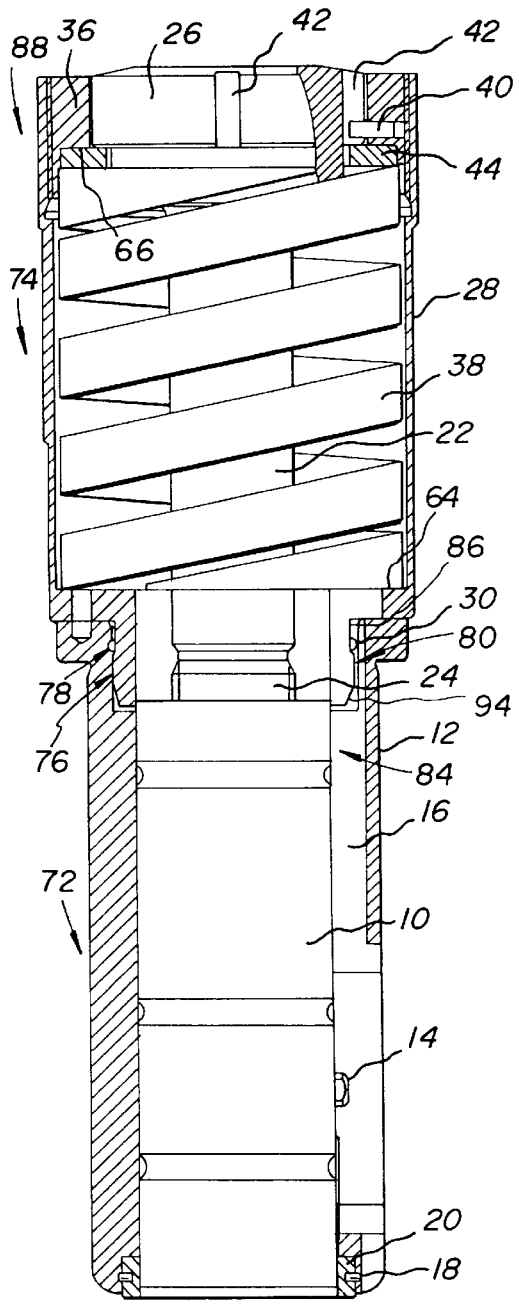
FIG. 1 is a lateral view, partially in section, of a punch unit in the completely assembled state.
Figure 2:
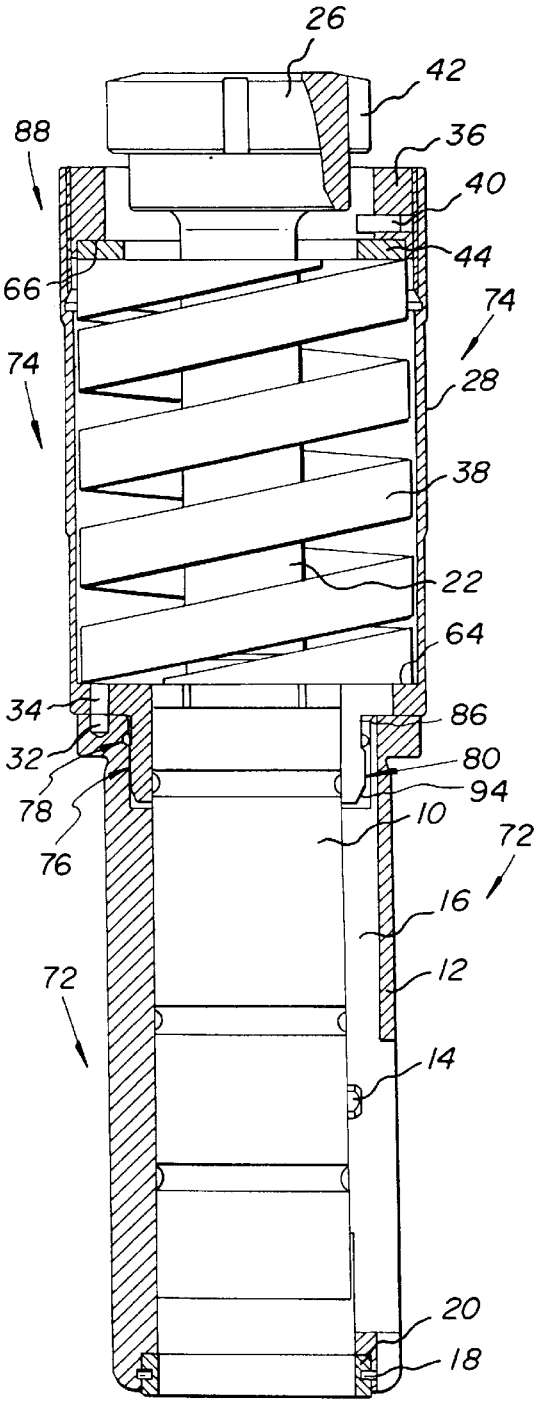
FIG. 2 is a view corresponding to FIG. 1 in a position of the parts wherein they are sufficiently pulled apart axially so that a respective relative rotation of the upper part in respect to the lower part is possible.

The punch unit represented in FIGS. 1 and 2 consists in a known manner of a punch 10 guided linearly displaceable in a guide bushing 12. A rotation of the punch 10 in relation to the guide bushing 12 is prevented by a pin 14, fixedly seated in a radial bore in the punch 10, which protrudes radially and engages an interior longitudinal groove 16 in the guide bushing 12. This longitudinal groove 16 is also radially outwardly open over a portion of its length, so that a pin, now shown, or other securing member can engage the groove 16 from the outside and can maintain the guide bushing 12 non-rotatingly on the machine frame, not shown. In this respect, as well as in relation to the disposition of a stripper ring 20 fastened on the lower end of the guide bushing 12 by a safety washer 18, the disclosed punch unit corresponds to conventional designs.

In further agreement with known punching tools, the back or upper end 84 of the punch 10 is screwed together with a punch driver 22. In the exemplary embodiment represented, the upper end 84 of the punch 10 is provided with a threaded bore for this purpose, into which the front end 24, which is provided with an exterior thread, of the shaft of the punch driver 22 is screwed. The total length of the punch 10 and the punch driver 22 is set by screwing the front end 24 of the punch driver 22 into the threaded bore of the punch 10 more or less deeply. The base seated at the back end of the punch driver 22 is identified by 26.

An unusual feature of the disclosed punch unit resides in that the front part 72 of the unit is extended at the back part 74 by a slip-on bushing 28. The slip-on bushing 28 has a tapered shoulder 86, or axially stepped surface at the front section 78 which fits by means of a sliding connection 76 into a widened back section 80 of the bore of the guide bushing 12, in which an O-ring 30 is seated which alternatively can also be placed on the exterior circumference of the tapered section 94 of the slip-on bushing 28. In the area of the tapered shoulder 86 the interior diameter of the slip-on bushing 28 is also greater than the exterior diameter of the punch 10, so that during the stroke of the punch the latter is freely axially displaceable and can be inserted from above or the back into the guide bushing 12 through the slip-on bushing 28. Otherwise the punch 10 can also be guided through the tapered front section of the slip-on bushing 28.

To connect the slip-on bushing 28 securely against relative rotation with the guide bushing 12, the latter is provided with securing means in the form of one or a plurality of axial bores 32 at a back section 80, which are engaged by a pin 34 seated in the tapered shoulder 86 of the slip-on bushing 28. Thus, in the assembled state the two bushings 12, 28 are frictionally engaged via the O-ring 30 and secured against relative rotation to form a sealed unit. In other words the punch unit is put together from a guide bushing 12 and a slip-on bushing 28, which could also be manufactured as one piece.

In the embodiment of FIGS. 1 and 2, the slip-on bushing 28 is provided with an interior thread at the rear end 88 into which a back spring bearing 36, preferably in the form of a set collar, is screwed as a ring insert. Back spring bearing 36 constitutes a back stop surface 66, for a compression spring 38 received in the slip-on bushing 28, which is supported at the front by a front stop surface or a front spring bearing 64, i.e., the shoulder formed by the taper. The desired pre-load of the compression spring 38 can be set by screwing the back spring bearing 36 more or less deeply into the interior thread of the slip-on bushing 28. The selected setting is then fixed in place by means of a radial protrusion 40, for example a securing screw which is screwed in from the inside into a radial threaded bore of the back spring bearing 36 until it engages the interior thread of the slip-on bushing 28. The radial protrusion 40 can be a set screw whose back end projects radially inward from the back spring bearing 36. Alternatively it is possible to embody one or a plurality of radial protrusions at the radial interior circumference of the back spring bearing 36, for example in a one piece construction, or in the form of pressed-in pins. In the assembled state as shown in FIG. 1, means for preventing rotation of the punch 10 relative to the bushings 28, 12 includes a radial protrusion 40 or a corresponding other radial protrusion which engages one of four axial longitudinal grooves 42, which are evenly distributed over the circumference of the exterior circumferential surface of the base 26, so that in this way the punch driver 22 is held fixed against relative rotation in respect to the bushings 28 and 12 and therefore also in respect to the punch 10. Since the longitudinal grooves 42 in the base 26 are continuous, i.e. open at both their axial ends, the punch 10 and the punch driver 22 can be easily assembled axially from the back, perform punching strokes in the assembled state shown in FIG. 1 and lifted out again toward the back or the top. It is only necessary to assure that in the course of their connection the radial protrusion 40 is aligned with one of the longitudinal grooves 42.

To improve the contact of the upper end of the compression spring 38, an intermediate ring 44 has been inserted between it and the back spring bearing 36, by means of which the spring 38 is supported on the back spring bearing 36. The interior diameter of the intermediate ring 44 has been selected to be such that the punch 10 and the shaft of the punch driver 22 can be guided through it. However, the base 26 has a larger exterior diameter, so that in the assembled state shown in FIG. 1 it rests on the back or upper front face of the intermediate ring 44. In the course of the stroke of the punch, the intermediate ring 44 therefore follows the axial movement of the base 26 against whose underside it is pressed by the compression spring 38.

The punch unit illustrated has the particular advantage that changes in the total length of the punch 10 and the punch driver 22 can be made very rapidly and simply. Starting with the position shown in FIG. 1, it is only necessary to lift the unit comprised of the punch 10 and the punch driver 22 in relation to the guide bushing 12 sufficiently far so that the radial protrusion 40 can move downward out of the groove which receives it and which is open at the ends. This retracted position of the punch driver 22 is illustrated in FIG. 2. If in this position or in a position which is even further lifted or retracted the punch driver 22 is turned in one or the other direction, while the punch 10, together with the guide bushing 12, is held, fixed against relative rotation, by the engagement of the pin 14 with the groove 16, the engagement length with which the front end 24 of the punch driver 22 which is provided with the exterior thread enters the threaded bore in the back end of the punch 10 is changed. Since the pitch of this thread is known, it is also known by what amount the total length of the punch 10 and the punch driver 22 is changed when the latter is rotated by the amount of the pitch angle between two grooves 42. It is understood that with an increase of the number of the grooves 42 distributed over the circumference the adjustment accuracy is increased. In the course of this, for example, there is also the option to embody the grooves 42 in the form of a toothing and the interior circumference of the back spring bearing 36 in the form of a matching interior toothing.

To make the setting of the total length of the punch 10 and the punch driver 22 easier, it is possible to apply visible markers to the existing grooves 42 at the exterior circumference of the slip-on bushing 28.

After setting the desired total length, it is only required to lower the punch driver 22 back into the operational position shown in FIG. 1 in which the radial protrusion 40 is again in engagement with one of the grooves 42.

Differing from the embodiment represented, the shaft of the punch driver 22 can be made in one piece with the punch 10. In this case the base 26 is screwed on the back of this unit, and the total length of the punch 10 and the punch driver 22 is adjusted in that the base 26 is screwed down to a greater or lesser extent and can then be fixed in place in the desired position, for example by means of a securing screw to be screwed into a radial threaded bore. Simultaneously this securing screw can radially project away outward from the base 26, analogously to the radial protrusion 40, and can be brought into engagement with one or a plurality of longitudinal grooves distributed over the circumference of the back spring bearing 36, unless the disposition represented in the drawings is preferred.

Based on the above description and the drawings it must be stated that the securing means, or safeguarding members which safeguard the rotational angle position of the punch driver 22 or at least of its base 26 in respect to the punch 10, i.e., radial protrusions 40 and oxial longitudinal grooves 42, are of a simple nature in regard to their structure and manufacturing techniques. A change of the total length of the punch 10 and the punch driver 22 can be performed more rapidly and simpler than before. As shown in a comparison between FIGS. 1 and 2, following the change in length it can be readily seen whether the punch driver is again correctly seated in the slip-on bushing 28. If the radial protrusion 40 has not been brought into correct engagement with one of the grooves 42 in the base 26, the latter extends radially toward the back out of the slip-on bushing 28.

Finally, there is the further advantage over the initially mentioned prior art, that the longitudinal grooves 42 required for a safeguard against relative rotation do not weaken the thread required for adjusting the length through which the pushing force is transmitted during punching. Since the longitudinal grooves 42 are located on the exterior circumference of the base 26 it is possible to cut several longitudinal grooves 42 without difficulty, even if the punch 10 only has a comparatively small circular or otherwise shaped cross section.

It is understood that further variants and designs of the above described details are possible, particularly regarding the connection between the slip-on bushing 28 and the guide bushing 12 and the shape of the slip-on bushing 28 as well as its connection with the back spring bearing 36. Because the punch 10 can be easily pulled out toward the back from the two bushings 12, 28, which are connected with each other, the bushings 12, 28 can also be connected with each other by means of, for example, a threaded connection which can be fixed in place, a bayonet connection or in another suitable manner, wherein the setting of the pre-load of the compression spring 38 can also be provided there, as in the case of a threaded connection. In addition, this as well as the embodiment illustrated in FIGS. 1 and 2 offers the option to perform a finer adjustment of the total length of the punch 10 and the punch driver 22, even with only a few longitudinal grooves 42 provided on the circumference, by either rotating the slip-on bushing 28 as a whole or the back spring bearing 36 in respect to the guide bushing 12 and then fixing the threaded connection in place again. The small change in the pre-load of the compression spring 38 taking place in this case is normally of no importance.

Figure 3:
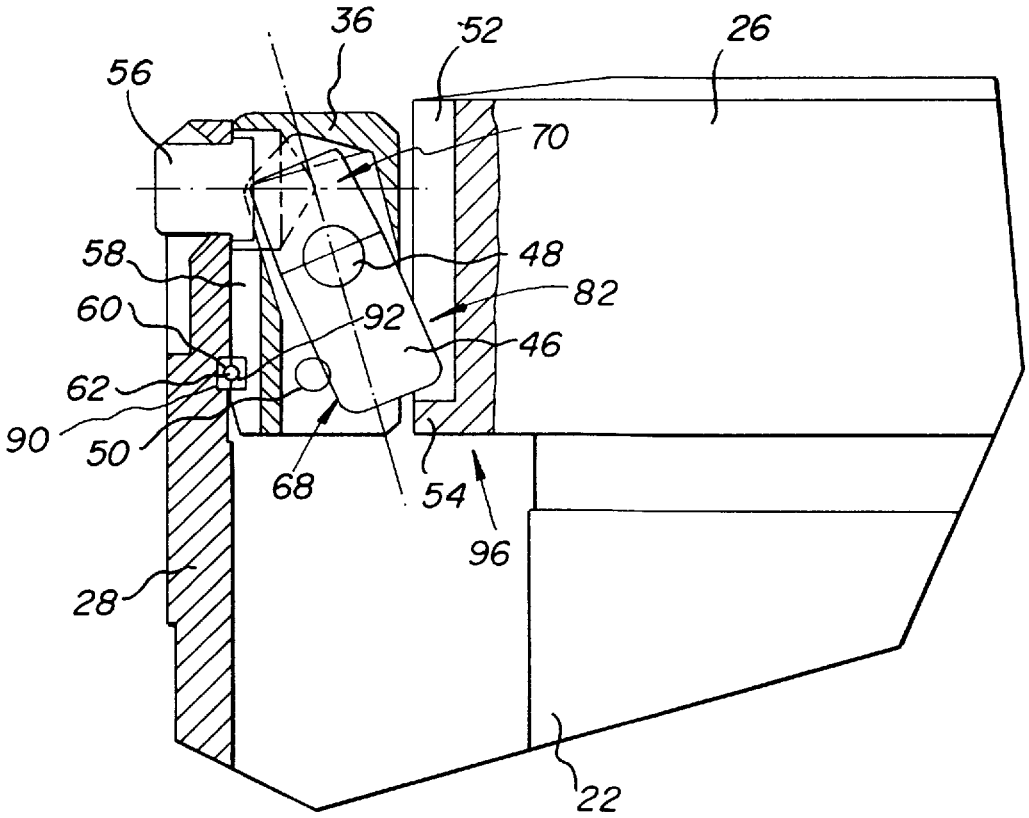
FIG. 3 is a partial section of the upper area of a variant embodiment of the punch until on an enlarged scale and in a sectional plane turned by 135° in relation to FIGS. 1 and 2.

When in the embodiment represented in FIGS. 1 and 2 no limitation of the reverse stroke of the unit consisting of the punch 10 and the punch driver 22 is provided, the latter with its base 26 can jump toward the rear out of the slip-on bushing 28 to a larger or smaller extent because of the strong and rapid action of the spring 38. This undesirably long reverse stroke can be braked by a brake ring, for example an O-ring, inserted into the back spring bearing 36, for example. However, this also includes the disadvantage that the base 26 of the punch driver can no longer be easily removed through the back of the slip-on bushing 28. In order to be able, on the one hand, to pull the unit consisting of the punch 10 and the punch driver 22 very easily and simply either partially or completely out of the slip-on bushing 28 toward the rear but, on the other hand, to effectively prevent the undesirable jumping out of the punch driver base 26 during operation of the punch device, a catch 46, illustrated in FIG. 3, is pivotably seated at the rear end of the slip-on bushing 28, preferably at the back spring bearing 36. It has the form of a two-arm lever. A pin 48, used as a pivot shaft, has been inserted in the position illustrated horizontally and tangentially to the back spring bearing 36. In this way the catch 46 is radially pivotable to a limited extent in a slit in the back spring bearing 36, which essentially extends axially and radially and is not completely cut through to thereby form interlocking contacts 82. A spring means, such as spring wire 50, pressing against the catch 46 radially from the outside in the forward end 68 or lower area, has the tendency to continuously pivot the catch 46 into the locking position shown in FIG. 3, wherein the catch 46 blocks a rearward movement of the punch driver base 26 out of the bushings 12, 28 toward the back or the top. In this position, the catch 46 engages an axially extending groove 52 in the circumferential surface of the punch driver base 26 to form connecting means interconnecting the bushings 12, 28 and the base. This axially extending groove 52, in contrast to the continuous grooves 42 open at both ends, is closed at the front or lower end by an end wall 96 forming a shoulder 54. In the exemplary embodiment, four grooves 52 evenly distributed over the circumference of the punch driver base 26 are provided, which are respectively located in the middle between two continuous grooves 42, and the catch 46 is arranged on the circumference, offset by 135° in relation to the radial protrusion 40.

Since in the locking position normally set by the spring wire 50 in accordance with FIG. 3 the catch 46 has a slight, resiliently maintained oblique position, in which its forward end 68 points radially inward, it can escape radially outward from the front edge of the punch driver base 26 in the course of the insertion of the unit consisting of the punch 10 and the punch driver 22 and the punch driver base 26. However, as soon as the end wall of the groove 52 forming the shoulder 54 has passed the catch 46 and the punch driver base is supported on the intermediate ring 44, the front or lower end of the catch 46 snaps with an audible click into the groove 52 behind the shoulder 54 and in this way blocks the rearward movement of the punch driver 22 and the punch 10.

To unlock the punch driver, a radially inward directed pressure is applied, by a user's finger or other pressure means, to an actuating button 56 seated in a fitting bore in the rear end of the bushings 12, 28. For example actuating button 56 may be manually depressed which in turn pushes radially from the exterior against the upper or rearward end 70 of the catch 46 and because of this pivots the catch 46 in a clockwise position and against the force of the spring wire 50 into a released or unlocked position, in which it no longer engages the groove 52, so that the punch driver 22 and punch driver base 26 and the punch 10 can be pulled out of the bushings 12, 28 toward the back or top.

The actuating button 56 at its radially inner end has a head of an increased diameter, so that the actuating button 56 cannot fall toward the outside out of the hole receiving it.

In the course of assembly, the back spring bearing 36 is inserted axially from above or the rear into the slip-on bushing 28. At the place at the circumference where the actuating button 56 is located, the back spring bearing 36 has an axial groove 58 in its exterior circumferential surface, which is axially open at the front, but closed at the rear end. The groove 58 is sufficiently wide and deep to receive the head of the actuating button 56. The actuating button 56 is therefore captively maintained following the assembly of the back spring bearing 36. Since it rests against the upper end of the catch 46 with its widened head, it is normally held in its radially outward position by the spring wire 50.

As can be furthermore seen from FIG. 3, an annular groove 90 has been cut into the interior circumferential surface of the slip-on bushing 28 at a defined distance from the rear end 88, and at approximately the same distance from the rear end 88 the back spring bearing 36 is also provided with an annular groove 92 in its exterior circumferential surface. In the assembled state the two annular grooves are located directly opposite each other and delimit an annular hollow space 60, into which a flexible wire 62, whose diameter is larger than the depth, measured in the radial direction, of each of the two oppositely located annular grooves, can be inserted from the outside via an approximately tangential bore, not shown, through the wall of the bushings 12, 28. Following insertion of the wire 62 the back spring bearing 36 is axially fixed in place.

Although the invention has been described in considerable detail with respect to preferred embodiments thereof, variations and modifications will be apparent to those skilled in the art without departing from the spirit and scope of the invention as set forth in the claims.

What is claimed is:

1. A punch unit comprising:

a punch driver having a front end and a back end;

a base positioned on said back end;

a punch having a back end connected to said front end of said punch driver;

a bushing receiving said punch and said punch driver and for guiding axial displacement of said punch;

means for preventing rotation of said punch relative to said bushing during a stroke of said punch;

a spring maintained under pre-load between a front stop surface and a back stop surface in said guide bushing, the back stop surface being closer to the base than the front stop surface; and connecting means interconnecting the bushing, rearward of the back stop surface, with the base for preventing the base from moving out of the bushing and for allowing at least partial removal of the base from the bushing, the connecting means comprising an axial groove on one of the bushing and the base, and including a shoulder at one end, and a releasable catch on the other of the bushing and the base, the releasable catch having a locking position in which it engages the groove such that upon attempted movement of the base out of the bushing, the catch and the shoulder engage each other to prevent such movement, the releasable catch having a released position in which the releasable catch is disengaged from the groove so that the base is axially separable from the bushing.

2. The punch unit according to claim 1 wherein said releasable catch comprises a two-arm lever having a forward end and a rearward end and being pivotable to a limited extent, said releasable catch including spring means for moving said forward end of said lever radially inward into said locking position in which said lever engages said shoulder to form a stop said forward end of said lever being movable radially outward into said released position by pressure means for providing a radially inwardly directed pressure on a rearward end of said lever.

3. The punch unit according to claim 2 wherein said spring means comprises one of a leaf spring and a spring wire for pre-loading said lever in a direction of said locking position.

4. The punch unit according to claim 2 wherein said pressure means comprises an actuating button seated in a radial bore near an open end of said bushing for engaging a recess in an exterior circumferential surface of said back stop surface.

5. The punch unit according to claim 4 wherein said actuating button includes a head having a larger diameter than said radial bore.

6. The punch unit according to claim 2 wherein said back stop surface comprises a back spring bearing and a back part of said bushing includes a radially outwardly open hole opening into oppositely located annular grooves in an interior circumferential surface and in an exterior circumferential surface of said back spring bearing, a flexible wire being insertable through said hole and between said annular grooves for axially fixing said back spring bearing in place in said bushing.

7. The punch unit according to claim 2 further comprising a pin positioned horizontally and tangentially to said back stop surface, said lever being pivotable about said pin.

8. The punch unit according to claim 1 wherein said front stop surface and said back stop surface comprise a front spring bearing and a back spring bearing disposed on said bushing, said spring being clamped between said front spring bearing and said back spring bearing.

9. The punch unit according to claim 8 wherein said bushing comprises two parts including a front part for guiding said punch attached to a back part in which said spring is seated under pre-load, said front part and said back part including securing means for preventing relative rotation.

10. The punch unit according to claim 9 wherein said front part and said back part of said bushing are attached by means of a sliding connection.

11. The punch unit according to claim 10 wherein said sliding connection is formed by insertion of a front section of said back part of said bushing into a back section of said front part of said bushing, and said securing means comprises at least one axial bore in said back section which engages a pin seated in said front section.

12. The punch unit according to claim 9 wherein said front spring bearing comprises a shoulder on said bushing and said back spring bearing comprises a set collar connected with an inner circumferential wall of said back part of said bushing.

13. The punch unit according to claim 12 wherein said set collar is connected to said inner circumferential wall of said back part of said bushing by threaded connection means for adjusting distance between said front spring bearing and said back spring bearing.

14. The punch unit according to claim 9 further comprising an intermediate ring inserted between said spring and said back spring bearing, said intermediate ring having an exterior diameter which exceeds an interior diameter of said back spring bearing and having an interior diameter which is smaller than an exterior diameter of said base of said punch driver, said intermediate ring being axially displaceably guided in said back part of said bushing.

15. The punch unit according to claim 1 wherein said punch and said punch driver are attached by means of a threaded connection.

16. The punch unit according to claim 1 wherein said punch driver and said punch are constructed as a single part attached to said base by threaded connection means for axial adjustment of said part with respect to said base.

17. The punch unit according to claim 1 wherein said means for preventing rotation comprises a radially protruding pin seated in a radial bore in said punch which engages an interior longitudinal groove in said bushing.

18. A punch unit comprising:

a punch driver having a front and a back end;

a base positioned on said back end;

a punch having a back end connected to said front end of said punch driver;

a bushing receiving said punch and said punch driver and for guiding axial displacement of said punch;

means for preventing rotation of said punch relative to said bushing during a stroke of said punch;

a spring maintained under pre-load between a front stop surface in said guide bushing, the back stop surface being closer to the base than the front stop surface; and securing means interconnecting the bushing, rearward of the back stop surface, with the base, the securing means comprising a radial protrusion on one of the bushing and the base and an axial longitudinal groove in the other of the bushing and the base rearward of the back stop surface to respectively operatively interconnect the punch driver to the punch to prevent relative rotation of the punch and punch driver during a stroke of the punch and operatively release the punch driver from the punch to allow relative rotation of the punch and punch driver for axial adjustment of the punch relative to the punch driver.

19. A punch unit according to claim 18 wherein one of said base and said bushing includes at least four longitudinal grooves which are evenly distributed over an exterior circumference thereof.

20. The punch unit according to claim 18 further comprising connecting means for preventing the base from moving out of the bushing and for allowing at least partial removal of the base from the bushing, the connecting means comprising an axial groove on one of the bushing and the base, the axial groove having a shoulder at one end thereof and a releasable catch on the other of the bushing and the base, the releasable catch having a locking position in which it engages the groove such that upon attempted movement of the base out of the bushing, the releasable catch and the shoulder engage each other to prevent such movement, the releasable catch having a released position in which the releasable catch is disengaged from the groove so that the base is axially separable from the bushing.

21. The punch unit according to claim 20 wherein said releasable catch comprises a two-arm lever having a forward end and a rearward end and being pivotable to a limited extent, said releasable catch including spring means for moving said forward end of said lever radially inward into said locking position in which said lever engages said shoulder to form a stop said forward end of said lever being movable radially outward into said released position by pressure means for providing a radially inwardly directed pressure on a rearward end of said lever.

22. The punch unit according to claim 18 wherein said front and back stop surfaces comprise front and back spring bearings disposed on said bushing, said spring being clamped between said front and back spring bearings.

23. The punch unit according to claim 22 wherein said bushing comprises two parts including a front part for guiding said punch attached to a back part in which said spring is seated under pre-load, said front part and said back part including securing means for preventing relative rotation.

24. The punch unit according to claim 23 wherein said front and back parts of said bushing are attached by means of a sliding connection.

25. The punch unit according to claim 24 wherein said sliding connection is formed by insertion of a front section of said back part of said bushing into a back section of said front part of said bushing, and said securing means comprises at least one axial bore in said back section which engages a pin seated in said front section.

26. The punch unit according to claim 23 wherein said front spring bearing comprises a shoulder on said bushing and said back spring bearing comprises a set collar connected with an inner circumferential wall of said back part of said bushing.

27. The punch unit according to claim 26 wherein said set collar is connected to said inner circumferential wall of said back part of said bushing by means of a threaded connection, whereby distance between said front and back spring bearings is adjustable.

28. The punch unit according to claim 23 further comprising an intermediate ring inserted between spring and said back spring bearing, said intermediate ring having an exterior diameter which exceeds an interior diameter of said back spring bearing and having an interior diameter which is smaller than an exterior diameter of said base of said punch driver, said intermediate ring being axially displaceably guided in said back part of said bushing.

29. The punch unit according to claim 18 wherein said punch and said punch driver are attached by means of a threaded connection.

30. The punch unit according to claim 18 wherein said punch driver and said punch comprise a single piece attached to said base by means of a threaded connection which is axially adjustable.

31. The punch unit according to claim 18 wherein said means for preventing rotation comprises a radially protruding pin seated in a radial bore in said punch which engages an interior longitudinal groove in said bushing.

* * * * *